US007347013B2

(12) United States Patent
Deschler et al.

(10) Patent No.: US 7,347,013 B2
(45) Date of Patent: Mar. 25, 2008

(54) CHUTE ROTATION AND LOCKING MECHANISM FOR SNOW THROWER

(75) Inventors: Scott Deschler, Kaukauna, WI (US); Perry Prochnow, Brillion, WI (US); Thomas R. Banse, Ontonagon, MI (US)

(73) Assignee: Ariens Company, Brillion, WI (US)

( * ) Notice: Subject to any disclaimer, the term of this patent is extended or adjusted under 35 U.S.C. 154(b) by 45 days.

(21) Appl. No.: 11/344,412

(22) Filed: Jan. 31, 2006

(65) Prior Publication Data

US 2007/0175070 A1 Aug. 2, 2007

(51) Int. Cl.
*E01H 5/09* (2006.01)

(52) U.S. Cl. ..... 37/260; 37/262

(58) Field of Classification Search ..... 37/260–262, 37/257–259

See application file for complete search history.

(56) References Cited

U.S. PATENT DOCUMENTS

| | | | |
|---|---|---|---|
| 2,200,623 | A | 5/1940 | James |
| 2,642,680 | A | 6/1953 | Curtis et al. |
| 3,075,813 | A | 1/1963 | Vohl |
| 3,313,386 | A | 4/1967 | Schwalm |
| 3,466,767 | A | 9/1969 | Rubin |
| 3,468,041 | A | 9/1969 | Mattson et al. |
| 3,570,641 | A | 3/1971 | Lefeuvre et al. |
| 3,580,351 | A | 5/1971 | Mollen |
| 3,742,626 | A | 7/1973 | Ellis |
| 3,760,517 | A | 9/1973 | Blaauw |
| 3,828,450 | A | 8/1974 | Boeck |
| 3,867,773 | A | 2/1975 | Gunderson |
| 3,879,866 | A | 4/1975 | Gunderson |
| 4,011,668 | A | 3/1977 | Gunderson |
| 4,068,397 | A | 1/1978 | Bacon |
| 4,150,501 | A | 4/1979 | Hayashi |
| 4,205,468 | A | 6/1980 | Greider |
| 4,549,365 | A | 10/1985 | Johnson |
| 4,694,594 | A | 9/1987 | Thorud et al. |
| 4,862,607 | A | 9/1989 | Wacker |
| 5,315,771 | A | 5/1994 | White et al. |
| 5,438,770 | A | 8/1995 | Miller |
| 5,444,927 | A | 8/1995 | Sosenko |
| 5,735,064 | A | 4/1998 | Holl |

(Continued)

FOREIGN PATENT DOCUMENTS

| | | |
|---|---|---|
| JP | 2-190505 | 7/1990 |

OTHER PUBLICATIONS

Machinery's Handbook, 25th edition, 1996, International Press, Inc., pp. 2042-2043.
Ariens, GT Tractor Attachment Parts Manual, 831 Series, 1993, pp. 1-50, Part No. 030887, Ariens Company, U.S.A.
Ariens, Sno-Thro Owner's & Parts Manual, 831 Series, Jul. 1998, pp. 1-24, Part No. 03084600B, Ariens Company, U.S.A.

(Continued)

*Primary Examiner*—Thomas A. Beach
*Assistant Examiner*—Mai T Nguyen
(74) *Attorney, Agent, or Firm*—Michael Best & Friedrich LLP

(57) ABSTRACT

A snow thrower having discharge chute locking and rotating mechanisms, both of which are actuated by a chute handle in the operator zone of the snow thrower. The chute locking mechanism disengages from the chute in response to initial movement of the chute handle in first or second directions, and the rotating mechanism rotates the discharge chute in response to continued movement of the chute handle in the same direction beyond the initial movement.

10 Claims, 7 Drawing Sheets

U.S. PATENT DOCUMENTS

| | | | | |
|---|---|---|---|---|
| 6,058,629 | A | 5/2000 | Peterson et al. | |
| 6,327,798 | B1 | 12/2001 | Sakai et al. | |
| 6,499,238 | B2 | 12/2002 | Kluck et al. | |
| 6,622,464 | B2 | 9/2003 | Goman | |
| 7,032,333 | B2 | 4/2006 | Friberg et al. | |
| 2004/0255493 | A1* | 12/2004 | Friberg et al. | 37/260 |
| 2006/0096134 | A1 | 5/2006 | Mercer et al. | |

OTHER PUBLICATIONS

Ariens, Sno-Thro Parts Manual, 938 Series, Aug. 1997, pp. 1-11, #03808500B, Ariens Company, U.S.A.

Ariens/Gravely, Sno-Thro Owner/Operator & Parts Manual, Model 831045, Aug. 2003, pp. 1-21, #03098300D, Ariens Company and Gravely, a Division of Ariens Company, U.S.A.

* cited by examiner

CHUTE ROTATION AND LOCKING MECHANISM FOR SNOW THROWER

BACKGROUND

The present invention relates to a mechanism for holding the discharge chute of a snow thrower in a selected position to direct a flow of snow in a selected direction, and for easily unlocking and rotating the discharge chute into another selected position.

SUMMARY

In one embodiment, the invention provides a snow thrower comprising: a chassis; wheels supporting the chassis; a prime mover supported on the chassis; means for creating a flow of snow to be thrown by the snow thrower under the influence of the prime mover; an operator zone including controls for operating the snow thrower; a chute rotatable about a substantially vertical axis to modify a direction in which the flow of snow is thrown; and a chute handle in the operator zone and movable in first and second opposite directions; a chute locking mechanism; a chute unlocking mechanism; and a chute rotating mechanism. The chute locking mechanism is biased into engagement with the chute to prevent rotational movement of the chute with respect to the chassis, and movable out of engagement with the chute to permit rotational movement of the chute with respect to the chassis. The chute locking mechanism will not moving out of engagement with the chute by mere application of torque to the chute. The chute unlocking mechanism moves the locking mechanism out of engagement with the chute in response to initial movement of the chute handle in either of the first and second directions. The chute rotating mechanism rotates the chute in response to continued movement of the chute handle beyond the initial movement in either of the first and second directions.

The snow thrower of the present invention may be a single-stage or two-stage snow thrower.

The chute unlocking mechanism may include a tension-transferring mechanism operably interconnecting the chute handle with the chute locking mechanism, such that initial movement of the chute handle in either of the first and second directions creates tension in the tension-transferring mechanism which moves the locking mechanism out of engagement with the chute.

The chute rotating mechanism may include a torque-transferring mechanism operably interconnected between the chute and the chute handle to transfer torque from the chute handle to the chute to cause rotation of the chute. The torque-transferring mechanism may include a rod interconnected with the chute handle to convert movement of the chute handle in the first and second directions into torque applied to the chute.

The chute unlocking and rotating mechanisms may also include first and second fulcrum rods within first and second slots, each slot having first and second ends. In such constructions, initial movement of the chute handle in the first direction causes the chute handle to pivot about the first fulcrum rod and causes the second fulcrum rod to move within the second slot until the second fulcrum rod abuts the second end of the second slot. This initial movement applies substantially no torque to the torque-transferring mechanism, but does apply tension to the tension-transferring mechanism to move the locking mechanism out of engagement with the chute. Continued movement of the handle in the first direction after the second fulcrum rod abuts the second end of the second slot applies torque to the torque-transferring mechanism to cause rotation of the chute.

In another embodiment the invention provides a snow thrower comprising: means for creating a flow of snow to be thrown by the snow thrower; a discharge chute movable between a plurality of positions for directing the flow of snow in a corresponding plurality of directions; a chute handle for moving the discharge chute into a selected one of the plurality of positions; a locking mechanism for holding the discharge chute in the selected position; and a lost motion mechanism operable to unlock the locking mechanism during initial chute handle movement to enable the discharge chute to rotate, and to rotate the discharge chute in response to continued chute handle movement in the same direction as the initial chute handle movement.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
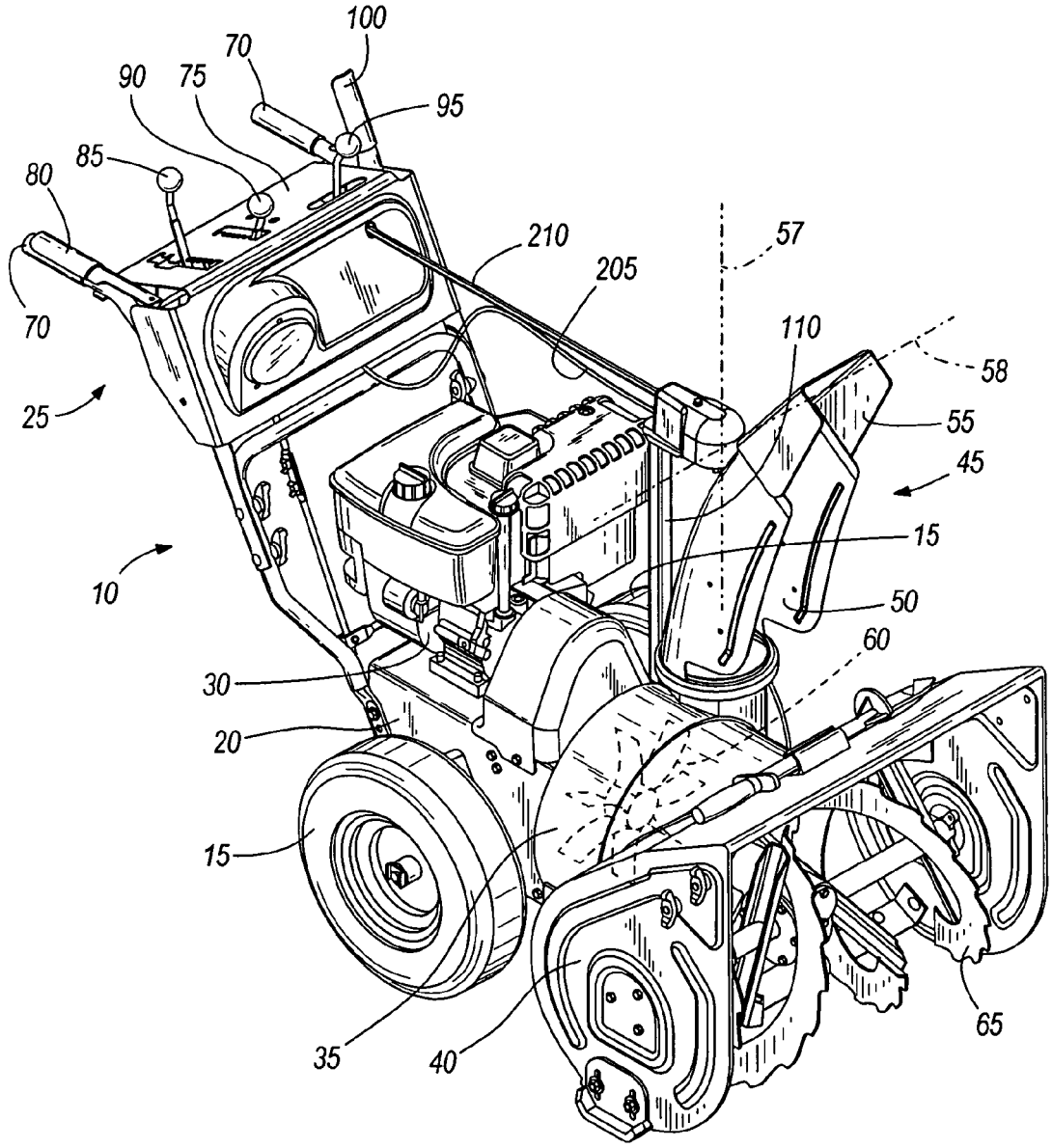
FIG. 1 illustrates a snow thrower according to the present invention.

FIG. 1 illustrates a snow thrower 10 that includes a pair of wheels 15 supporting a chassis 20. The snow thrower 10 also includes an operator zone 25 at the rear of the snow thrower where the operator of the snow thrower walks behind and controls the operation of the snow thrower. In ride-on snow thrower embodiments, the operator zone is typically at the rear of the snow thrower where the operator rides on and controls operation of the snow thrower, rather than walking behind the snow thrower.

A prime mover 30, which may be for example a four- or two-stroke engine, is mounted on the chassis 20 and may be used to drive one or both of the wheels 15. Mounted to the front of the chassis 20, and for the purposes of this specification part of the chassis 20, are an impeller housing 35 and an auger housing 40. The impeller housing 35 has mounted to it a discharge chute assembly 45, which includes a chute 50 that is rotatable with respect to the impeller housing 35 about a substantially vertical axis 57, and a deflector 55 that is pivotable with respect to the chute 50 about a substantially horizontal axis 58. The angular position of the chute 50 will determine the direction in which a flow of snow from the snow thrower 10 is directed as it is discharged from the chute 50, and the angular position of the deflector 55 will determine the height at which the snow is thrown in that direction.

The illustrated snow thrower 10 is of the two-stage variety and therefore includes an impeller or fan 60 within the impeller housing 35, and an auger 65 within the auger housing 40. Both the impeller 60 and auger 65 rotate under the influence of the prime mover 30. As it rotates, the auger 65 draws snow into the auger housing 40 and pushes it back to the impeller housing 35. The rotating impeller 60 throws the snow up through the chute assembly 45. In other embodiments, the snow thrower 10 may be of the single-stage variety in which a single auger/impeller element both draws the snow in and throws the snow up through the chute assembly 45.

The operator zone 25 includes a pair of handles 70 and a control panel 75 between the handles 70. Mounted to the handles 70 or extending through the control panel 75 are a series of controls for the operation of the snow thrower 10 and its parts. The controls include a clutch lever 80 for engaging or disengaging the auger 65 and impeller 60 with respect to the prime mover 30, a speed selector 85 for selecting the rate at which and direction in which the prime mover 30 drives the wheels 15, a deflector control handle 90 for adjusting the angle of the deflector 55 with respect to the chute 50, a chute control handle 95 for rotating the chute 50 about its vertical axis of rotation 57, and a traction drive clutch lever 100 for engaging and disengaging the wheels 15 with respect to the prime mover 30.

Figure 2:
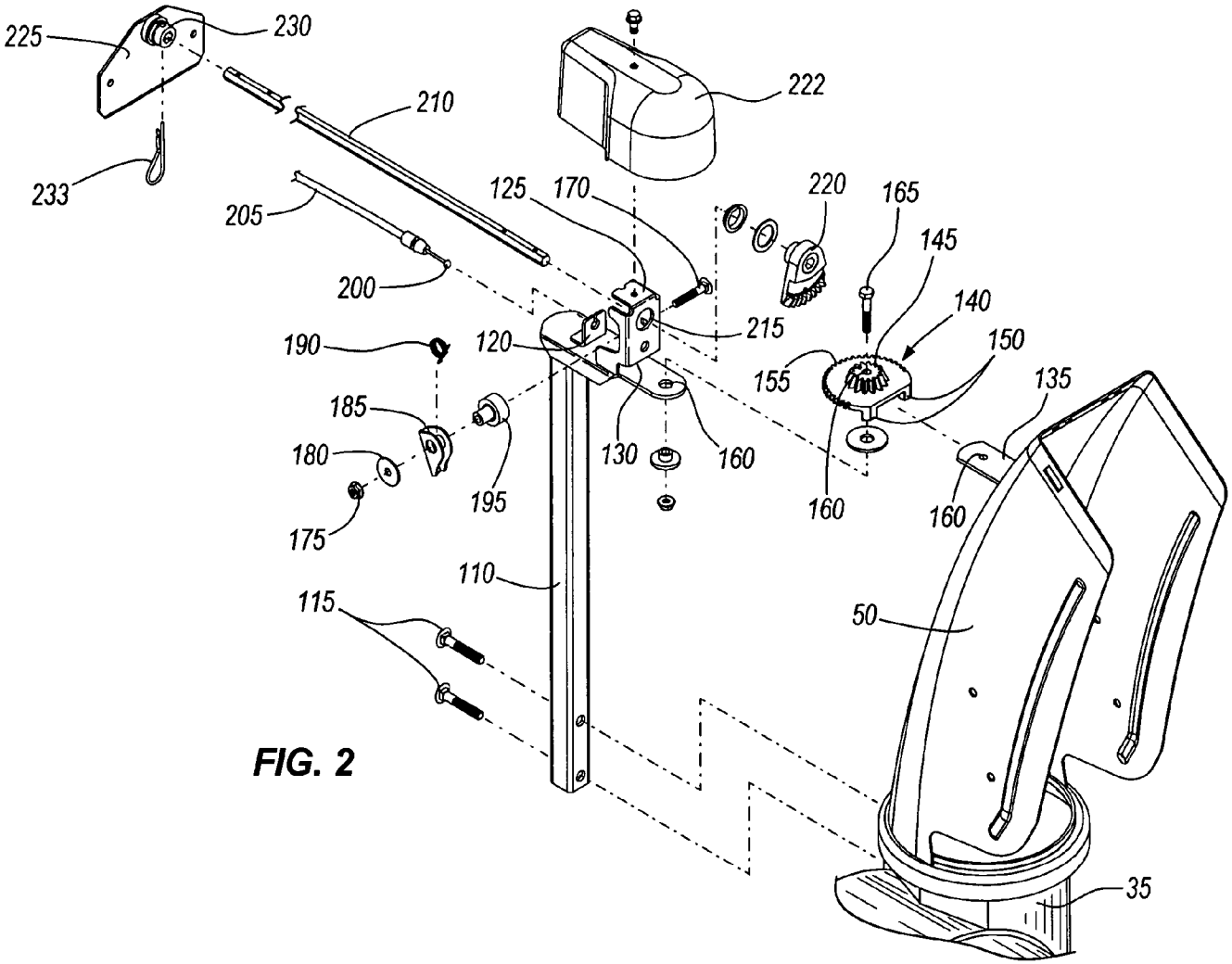
FIG. 2 is an exploded view of a portion of a chute rotation and locking mechanism.

With reference to FIG. 2, a chute support pedestal 110 is mounted to the impeller housing 35 with a pair of bolts 115 and extends vertically alongside the chute 50. The top of the chute support pedestal 110 extends over the vertical axis of rotation 57 of the chute 50. The chute support pedestal 110 includes a generally upright cable support 120 and a generally upright rod support 125. A window 130 is defined between the bottom of the rod support 125 and the top surface of the chute support pedestal 110.

The chute 50 includes a tab 135 extending over the top of the chute support pedestal 110. A chute gear 140 includes a bevel gear portion 145 on its top, a pair of fingers 150 depending from its bottom, and teeth 155 around a portion of its perimeter. The chute gear 140 sits on top of the chute tab 135 with the fingers 150 engaging opposite sides of the tab 135. Holes 160 in the chute support pedestal 110, chute tab 135, and chute gear 140 align with each other and with the vertical axis of rotation 57 of the chute 50. A pivot bolt 165 extends through the aligned holes 160 and permits-the chute 50 to pivot with respect to the chute support pedestal 110 about the vertical axis of rotation 57 of the chute 50. Because the chute tab 135 is trapped between the fingers 150 of the chute gear 140, the chute gear 140 is coupled for rotation with the chute 50, and rotation of the chute gear 140 causes rotation of the chute 50.

A portion of the toothed perimeter 155 of the chute gear 140 extends through the window 130 between the rod support 125 and the top of the chute support pedestal 110. A bolt 170 extends horizontally through a side of the rod support 125 and supports a nut 175, a washer 180, a chute locking arm 185, a torsion spring 190, and a bushing 195 in cantilever fashion. The chute locking arm 185 is pivotable about the bolt 170, and is biased by the torsion spring 190 into engagement with the chute gear teeth 155. When engaged with the chute gear teeth 155, the locking arm 185 prevents rotation of the chute gear 140 and therefore prevents rotation of the chute 50. The locking arm's engagement with the chute gear teeth 155 cannot be overcome merely by applying torque to the chute 50 (i.e., it is not a resilient detent or a mere frictional engagement) without bending or breaking the locking arm 185. The flow of snow through the discharge chute 50 applies dynamic forces to the chute 50, some of which apply torque to the chute 50 about the vertical axis 57. The locking arm 185 resists such dynamic forces to keep the chute 50 in the position selected by the operator.

A tension-transferring mechanism and a torque-transferring mechanism are supported by the cable support 120 and rod support 125, respectively. In the illustrated embodiment, the tension-transferring mechanism includes a cable 200 and a sheath 205 around the cable 200. The cable 200 is slidable within the sheath 205. The sheath 205 is connected to the cable support 120, and the cable 200 has a ball-shaped end that fits within a key-slot in the locking arm 185. When tension is applied to the opposite end of the cable 200 (as described in more detail below), the cable 200 slides in one direction within the sheath 205 and pulls the locking arm 185 out of engagement with the chute gear teeth 155. When the tension is released, the torsion spring 190 slides the cable 200 in the opposite direction within the sheath 205 while biasing the locking arm 185 back into engagement with the chute gear teeth 155.

The torque-transferring mechanism in the illustrated embodiment includes a rod 210 having a hexagonal cross-section. The rod 210 extends through a hole 215 in the rod support 125 and is supported by the rod support 125 for rotation. Affixed to one end of the rod 210 is a bell crank 220 having teeth that mesh with the bevel gear portion 145 of the chute gear 140. The bell crank 220 is fixed for rotation with the rod 210, either through a hexagonal bore that mates with the rod 210 or any other suitable means for coupling the rod 210 and bell crank 220 for rotation together. In other embodiments, a worm gear may be used in place of the illustrated bell crank 220, in which case the worm gear would run alongside the bevel gear portion 145 of the chute gear 140. When the locking arm 185 is disengaged from the chute gear teeth 155, torque applied to the opposite end of the rod 210 (as described in more detail below) causes the bell crank 220 to rotate, which in turn causes the chute gear 140 to rotate. Rotation of the chute gear 140 imparts torque to the chute 50 through the engagement of the fingers 150 with the tab 135 to rotate the chute 50 about the vertical axis of rotation 57. A cover 222 mounts over the top of the chute support pedestal 110 and covers the ends of the rod 210 and cable/sheath assembly 200, 205, the chute gear 140, and the bell crank 220.

Figure 3:
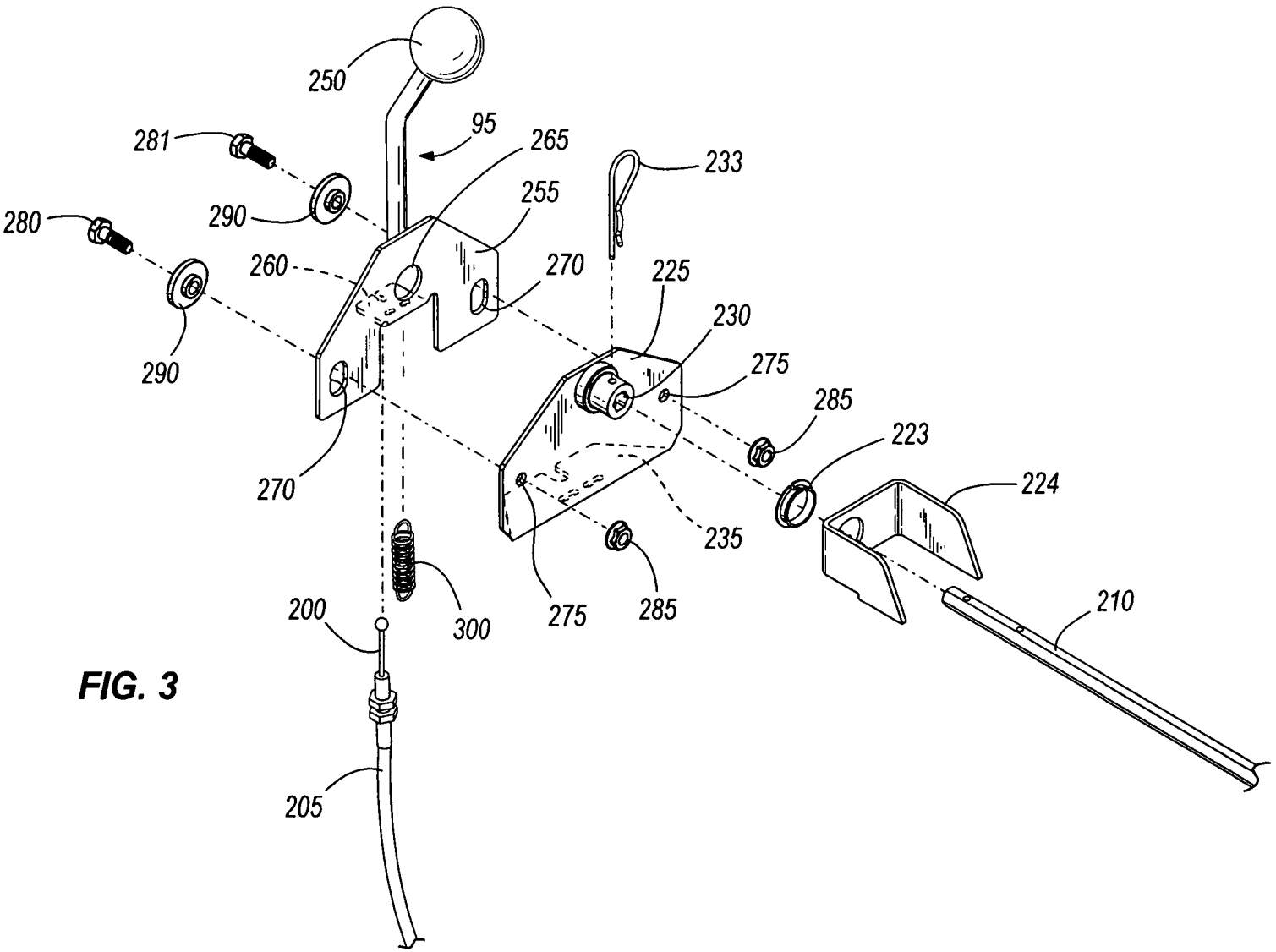
FIG. 3 is an exploded view of another portion of the chute rotation and locking mechanism.
Figure 4:
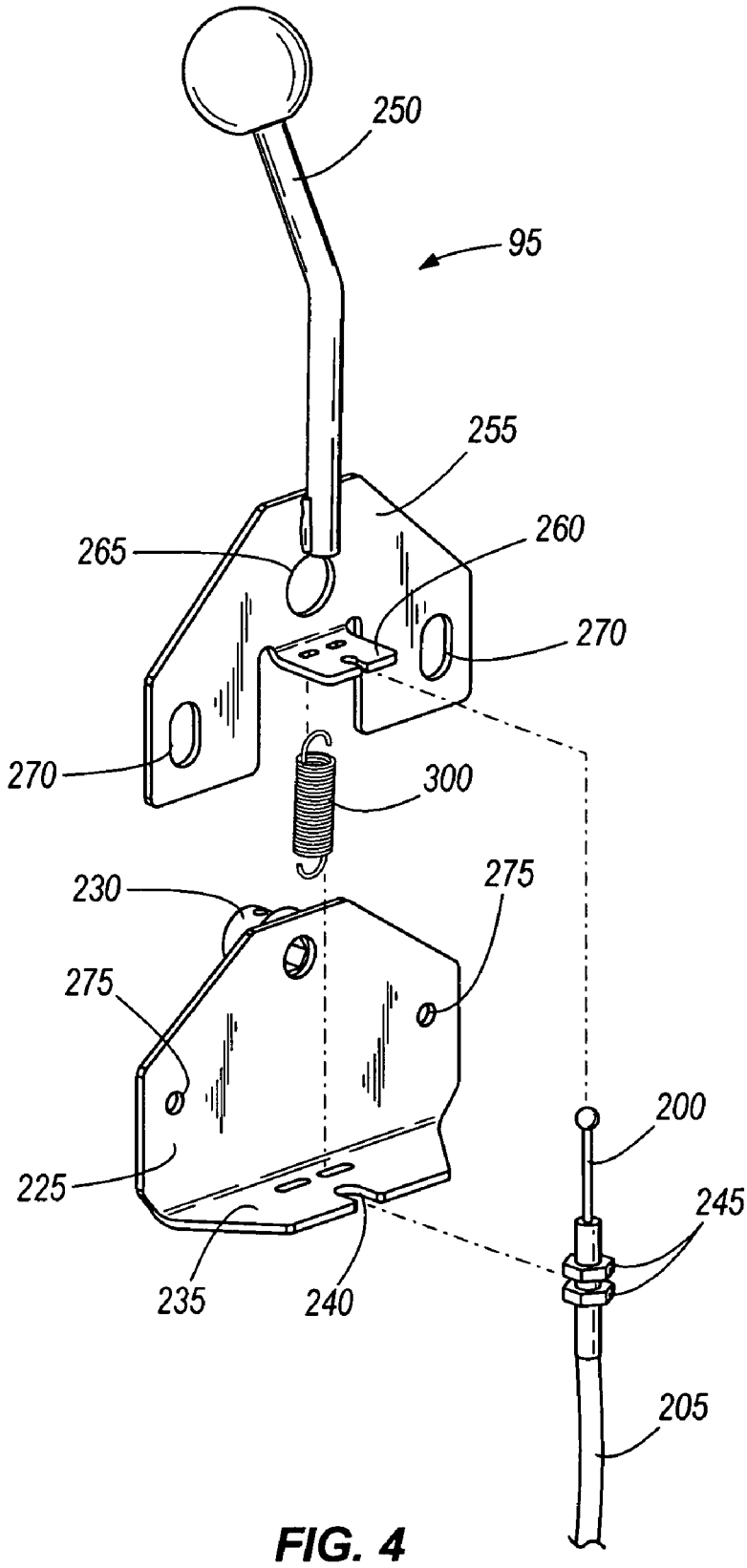
FIG. 4 is an enlarged exploded view of a portion of the chute rotation and locking mechanism.

With reference to FIGS. 3 and 4, the rod 210 is supported for rotation by a bushing 223 in a bracket 224 mounted under the control panel 75. Affixed to the end of the rod 210 opposite the end supported by the rod support 125 is a control mount plate 225. The control mount plate 225 includes a hex-shaped through-hole 230 to accommodate the rod 210 and couple the control mount plate 225 and rod 210 for rotation together. A cotter pin 233 prevents the rod 210 from sliding out of the through-hole 230. In alternative embodiments, the control mount plate 225 may be welded or otherwise rigidly affixed to the rod 210. In this regard, the control mount plate 225 may be considered part of the torque-transferring mechanism. The control mount plate 225 includes a bottom flange 235 that has a slot 240 that receives the end of the sheath 205 opposite the end secured to the cable support 120. Top and bottom adjustment nuts 245 are threaded against the flange 235 to secure the sheath 205 and adjust the cable 200.

The chute handle 95 includes an upper portion 250 that extends up through the control panel 75 and that is grasped by the operator, and a lower, wider portion 255 below the control panel 75. The lower portion 255 of the chute handle 95 has a rearwardly-extending fork 260 into which the ball-shaped end of the cable 200 is received. The lower portion 255 also includes a hole 265 to accommodate the end of the rod 210, but the rod 210 and handle 95 are not coupled for rotation together through the hole 265. Rather, the hole 265 is large enough to permit pivoting of the chute handle 95 with respect to the rod 210 during initial rotation of the chute handle 95 (described in more detail below).

The lower portion 255 of the handle 95 also includes a pair of slots 270 that align with a pair of holes 275 in the control mount plate 225. First and second bolts or fulcrum rods 280, 281 extend through the respective aligned pairs of slots 270 and holes 275, and are secured on the opposite side of the control mount plate 225 with locking nuts 285. Bushings 290 are secured within the slots 270 around the first and second fulcrum rods 280, 281. In other embodiments, the slots 270 may be formed in the control mount plate 225 rather than in the lower portion 255 of the handle 95. In other embodiments, the fulcrum rods 280, 281 may take the form of studs permanently affixed to or integral with the control mount plate 225 or handle 95 and slidable in slots formed in the other of the control mount plate 225 or handle 95.

Figure 5:
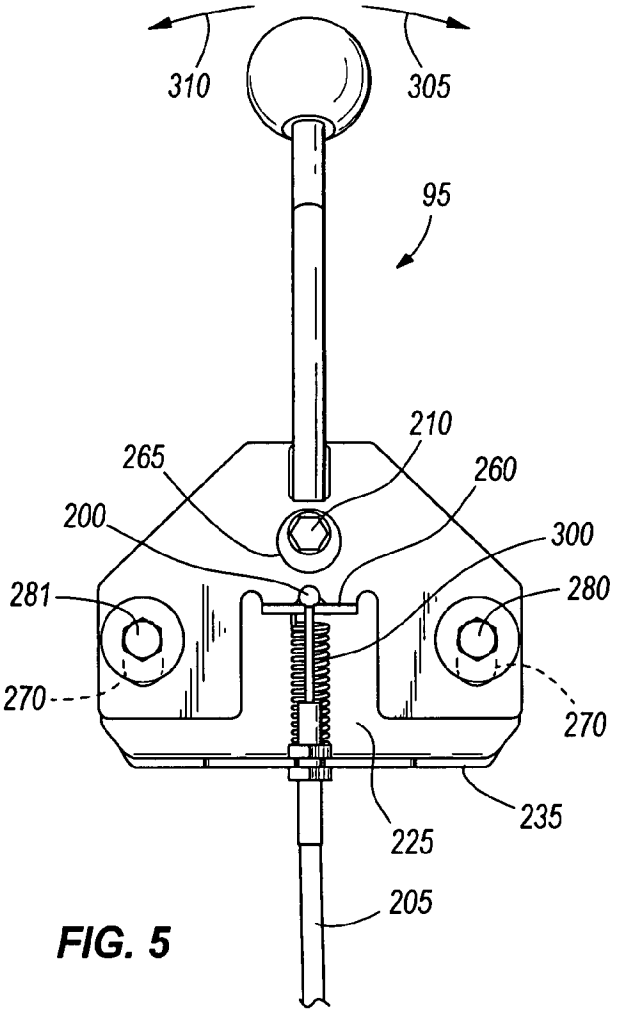
FIG. 5 is an end view of the chute handle in a neutral, at-rest position.

FIG. 5 illustrates the chute handle 95 in an at-rest or neutral position. A tension spring 300 extends between the bottom flange 235 of the control mount plate 225 and the fork 260 of the chute handle 95. The tension spring 300 biases the chute handle 95 into the neutral position in which both the first and second fulcrum rods 280, 281 are at the tops of the associated slots 270 in the chute handle 95. The spring bias of the torsion spring 190 acting on the opposite end of the cable 200 through the locking arm 185 provides an additional biasing force to move the chute handle 95 into the neutral position.

When in the neutral position, the cable 200 permits the locking arm 185 to engage the chute gear teeth 155. When the chute handle 95 is moved in a first direction 305, it pivots on the first fulcrum rod 280 (see FIG. 6) with respect to the control mount plate 225 until the second fulcrum rod 281 bottoms out in its slot 270. Movement of the chute handle 95 in a second direction 310 (see FIG. 7) opposite the first direction 305 causes the handle 95 to pivot on the second fulcrum rod 281 until the first fulcrum rod 280 bottoms out in its slot 270. In the illustrated embodiment, the first and second fulcrum rods 280, 281 bottom out in their respective slots 270 because the slots 270 pivot with respect to the fulcrum rods 280, 281 and actually bring the bottoms of the slots 270 into engagement with the fulcrum rods 280, 281. In other embodiments, the fulcrum rods 280, 281 could reach the ends of the slots 270 because the fulcrum rods are moved while the slots remain stationary (e.g., if the fulcrum rods 280, 281 pivot with the chute handle 95 and the slots are formed in the control mount plate 225).

The slot 270 and fulcrum rod 280, 281 configuration provides an initial period of lost motion in which movement of the chute handle 95 does not apply torque to the rod 210. The hole 265 in the bottom portion 255 of the chute handle 95 is sufficiently large to accommodate the lost-motion pivoting of the handle 95 without bumping into the rod 210.

Figure 6:
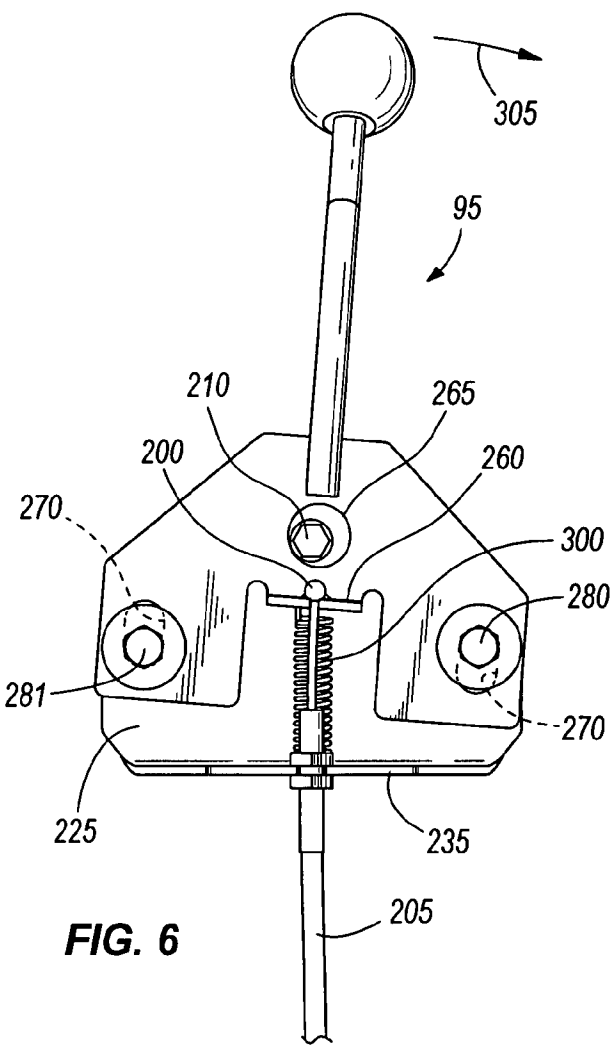
FIG. 6 is an end view of the chute handle moved in a first direction.
Figure 7:
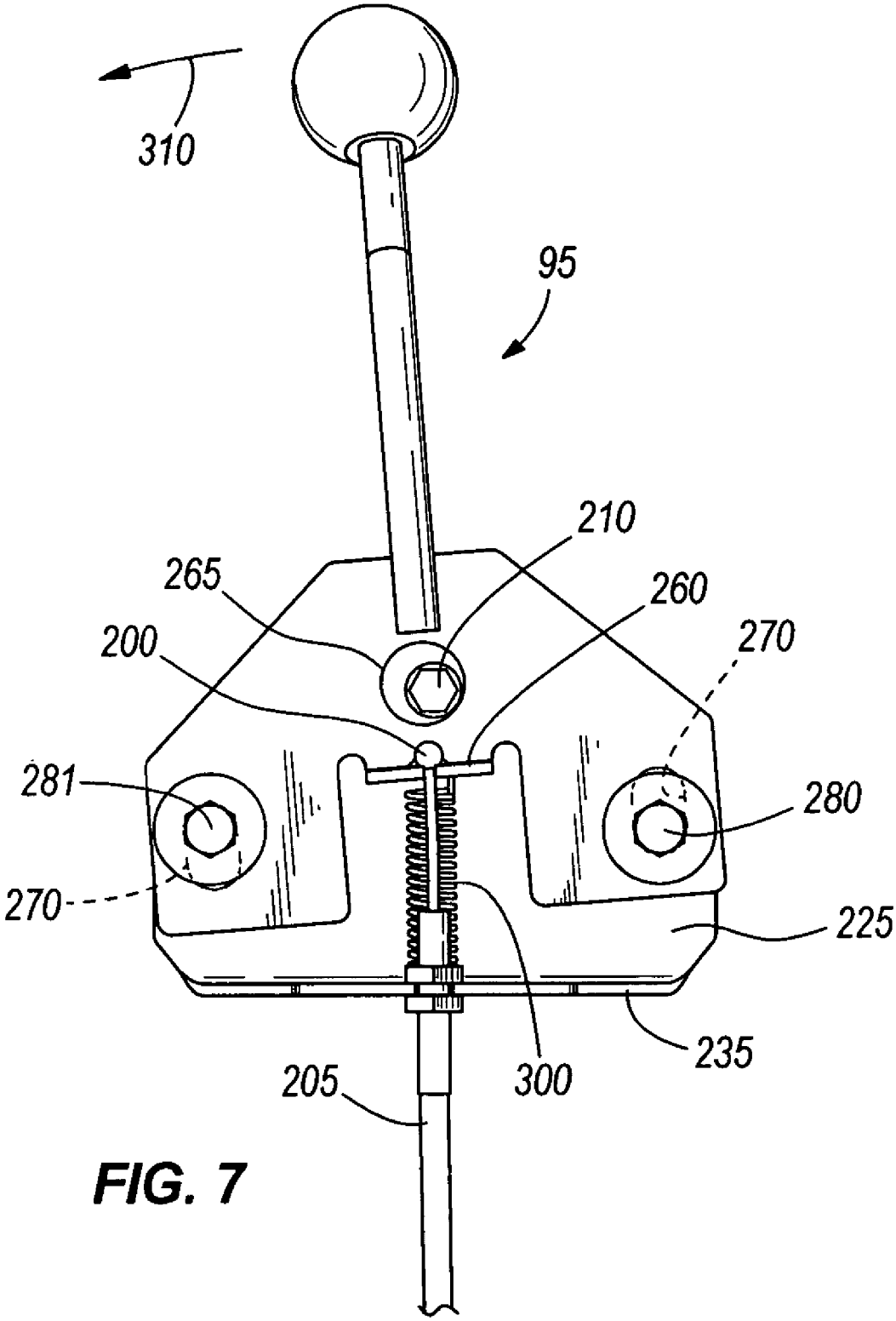
FIG. 7 is an end view of the chute handle moved in a second direction.
Figure 8:
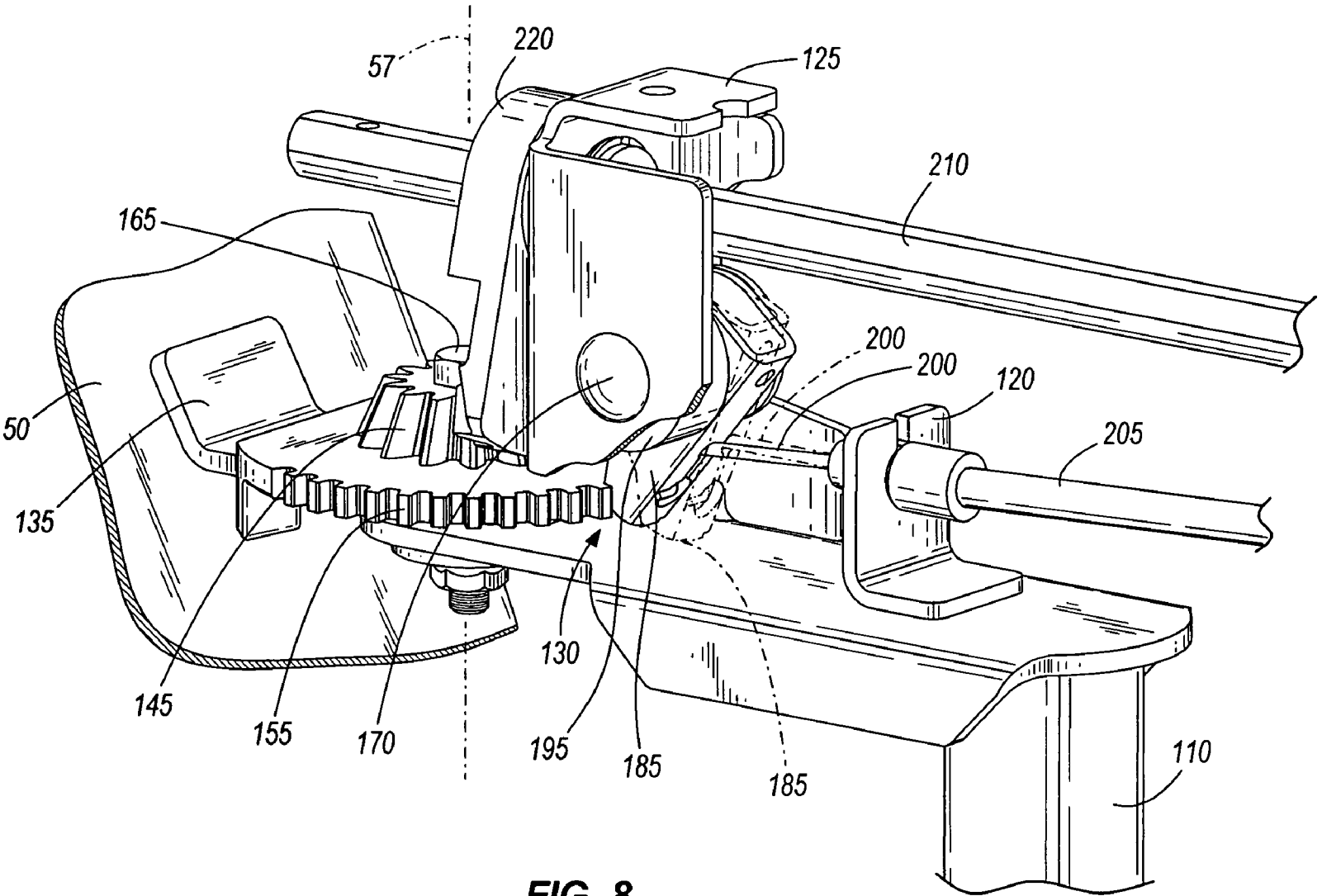
FIG. 8 is an enlarged perspective view of the chute locking mechanism, illustrating the locking arm in an engaged position in solid lines and in a disengaged position in phantom.

During the initial period of lost motion, the distance between the fork 260 of the chute handle 95 and the flange 235 of the control mount plate 225 increases. Because the sheath 205 is fixed with respect to the flange 235 of the control plate 225 and the end of the cable 200 is fixed with respect to the fork 260 of the chute handle 95, this initial period of lost motion slides the cable 200 in the sheath 205 and pulls the locking arm 185 out of engagement with the chute gear teeth 155. FIGS. 6 and 7 illustrate the first end of the cable 200 being pulled out of the sheath 205 in response to the lost-motion pivoting, and FIG. 8 illustrates (in phantom) the locking arm 185 coming out of engagement with the chute gear teeth 155 as the second end of the cable 200 is pulled into the sheath 205 as a result of the lost-motion pivoting.

After one of the fulcrum rods 280, 281 is at one end of its slot 270 and the other fulcrum rod is at the opposite end of its slot 270 (i.e., after the initial chute handle movement), continued movement of the chute handle 95 in the same direction 305 or 310 applies torque to the rod 210 and rotates the chute 50 as discussed above. During rotation of the rod 210, the control mount plate 225 and chute handle 95 rotate into a new orientation. When the chute handle 95 is released, the springs 190, 300 bias the chute handle 95 into the neutral position with respect to the control mount plate 225, but the axis of the handle 95 will not necessarily be vertical.

The ratio of chute 50 rotation to chute handle 95 pivoting preferably exceeds 1:1 and may be 2:1 or higher. In the illustrated embodiment, for example, the chute 50 may be rotated through 180 degrees with less than 90 degrees of chute handle 95 rotation. Such high ratios enable the operator to quickly pivot the chute 50 to the desired position to help maximize snow clearing time. Once the chute 50 has been pivoted into the desired position, the control handle 95 is released by the operator of the snow thrower 10 and is biased back into the neutral position by the tension and torsion springs 300, 190. Simultaneously, the locking arm 185 is moved into engagement with the chute gear teeth 155 to hold the chute 50 in the desired position until it is again moved by the operator.

The present invention therefore permits an operator to unlock and rotate the discharge chute 50 in one fluid movement of the chute handle 95, with the initial movement of the chute handle 95 unlocking the chute 50 and continued movement of the chute handle 95 in the same direction rotating the chute 50. When the chute handle 95 is released, it is automatically biased back into its neutral position with respect to the control mount plate, and the locking arm 185 is biased back into engagement with the chute gear teeth 155.

In view of the foregoing, the illustrated snow thrower 10 has a chute locking mechanism, the main components of which are the locking arm 185, torsion spring 190, and the chute gear teeth 155 and finger 150 of the chute gear 140. When engaged, the locking mechanism prevents rotation of the discharge chute 50. When the chute locking mechanism is disengaged, the chute 50 is free to rotate.

The illustrated snow thrower 10 also has a chute unlocking mechanism, the main components of which are the cable 200, sheath 205, fork portion 260, flange 235, fulcrum rods 280, 281, and slots 270. The fulcrum rods 280, 281 and slots 270 provide a period of lost motion during initial movement of the chute handle 95, in which the chute handle 95 is pivotable with respect to the control mount plate 225 to slide the cable 200 in the sheath 205 and pull the locking arm 185 out of engagement with the chute gear teeth 155.

The illustrated snow thrower 10 also has a chute rotating mechanism, the main components of which are the fulcrum rods 280, 281, slots 270, rod 210, bell crank 220, bevel gear portion 145, and fingers 150. When the fulcrum rods 280, 281 bottom and top out in opposite ends of the slots 270, continued movement of the chute handle 95 in that direction applies torque to the rod 210, which is transformed into rotation of the chute gear 140 through the engagement of the bell crank 220 and bevel gear portion 145. This rotation is transferred to the chute 50 through the engagement of the chute tab 135 by the fingers 150.

Although the illustrated embodiment includes the above-mentioned main components of the chute locking mechanism, chute unlocking mechanism, and chute rotating mechanism, those mechanisms and all other aspects of the invention are not limited to the components described above and illustrated in the drawings. The invention may be embodied in other constructions that include all, some, or none of the specific components described above and illustrated in the drawings, and is limited only by the language of the following claims below.

The invention claimed is:

1. A snow thrower comprising:

a chassis;

wheels supporting the chassis;

a prime mover supported on the chassis;

means for creating a flow of snow to be thrown by the snow thrower under the influence of the prime mover;

an operator zone including controls for operating the snow thrower;

a chute rotatable about a substantially vertical axis to modify a direction in which the flow of snow is thrown;

a chute handle in the operator zone and movable in first and second opposite directions;

a chute locking mechanism biased into engagement with the chute to prevent rotational movement of the chute with respect to the chassis, and movable out of engagement with the chute to permit rotational movement of the chute with respect to the chassis, the chute locking mechanism not moving out of engagement with the chute by mere application of torque to the chute;

a chute unlocking mechanism moving the locking mechanism out of engagement with the chute in response to initial movement of the chute handle in either of the first and second directions; and a chute rotating mechanism rotating the chute in response to continued movement of the chute handle in the same direction as the initial movement.

2. The snow thrower of claim 1, wherein the means for creating a flow of snow includes an auger for collecting snow into the snow thrower and an impeller for throwing the collected snow upward through the chute.

3. The snow thrower of claim 1, wherein the chute locking mechanism includes a toothed mechanism and a locking mechanism biased into engagement with the toothed mechanism, and wherein the chute unlocking mechanism includes a mechanism for overcoming the bias on the locking mechanism to move the locking mechanism out of engagement with the toothed mechanism and permit rotation of the chute.

4. The snow thrower of claim 1, wherein the chute unlocking mechanism includes a tension-transferring mechanism operably interconnecting the chute handle with the chute locking mechanism, wherein initial movement of the chute handle in either of the first and second directions creates tension in the tension-transferring mechanism which moves the locking mechanism out of engagement with the chute.

5. The snow thrower of claim 4, wherein the chute rotating mechanism includes a torque-transferring mechanism having first and second ends, the first end being interconnected to the chute, the torque-transferring mechanism transferring torque applied to the second end into torque applied to the chute; and wherein the chute unlocking mechanism further includes:

first and second slots in one of the chute handle and the second end of the torque-transferring mechanism, the first and second slots each having first and second ends; and first and second fulcrum rods mounted to the other of the chute handle and the second end of the torque-transferring mechanism, and received within the respective first and second slots;

wherein initial movement of the chute handle in either of the first and second directions causes relative movement between the chute handle and the torque-transferring mechanism, which relative movement moves the first and second fulcrum rods into opposite ends of the respective first and second slots and results in tension in the tension-transferring mechanism, but results in substantially no torque applied to the second end of the torque-transferring mechanism.

6. The snow thrower of claim 5, wherein movement of the chute handle in either of the first and second directions beyond the initial movement applies torque to the second end of the torque-transferring mechanism due to the engagement of the first and second fulcrum rods in opposite ends of the respective first and second slots.

7. A snow thrower comprising:

a chute for directing a flow of snow in a snow-throwing direction;

a chute handle rotatable in first and second directions to rotate the chute and change the snow-throwing direction;

a chute locking mechanism movable into and out of engagement with the chute to prevent and permit, respectively, rotational movement of the chute;

a tension-transferring mechanism interconnecting the chute handle and the locking mechanism and converting movement of the chute handle in the first and second directions into tension to move the locking mechanism out of engagement with the chute;

a torque-transferring mechanism interconnecting the chute handle with the chute and transferring movement of the chute handle into torque to rotate the chute; and a lost motion mechanism between the chute handle and the torque-transferring mechanism, causing initial movement of the chute handle in either of the first and second directions to apply tension to the tension-transferring mechanism but not apply torque to the torque-transferring mechanism such that the locking mechanism is disengaged from the chute, and permitting continued movement of the chute handle beyond the initial movement and in the same direction as the initial movement to apply torque to the torque-transferring mechanism to cause rotation of the chute.

8. A snow thrower comprising:

means for creating a flow of snow to be thrown by the snow thrower;

a discharge chute movable between a plurality of positions for directing the flow of snow in a corresponding plurality of directions;

a chute handle for moving the discharge chute into a selected one of the plurality of positions;

a locking mechanism for holding the discharge chute in the selected position; and a lost motion mechanism operable to unlock the locking mechanism during initial chute handle movement to enable the discharge chute to rotate, and to rotate the discharge chute in response to continued chute handle movement in the same direction as the initial chute handle movement.

9. The snow thrower of claim 8, further comprising a biasing member applying a biasing force to the locking mechanism to bias the locking mechanism into engagement with the discharge chute.

10. The snow thrower of claim 8, further comprising:

a torque-transferring mechanism for transferring chute handle movement into rotation of the discharge chute;

wherein the lost motion mechanism includes a pair of slots in one of the chute handle and the torque-transferring mechanism, and a pair of fulcrum rods, one being received within each of said pair of slots;

wherein the initial chute handle movement includes abutting one of the fulcrum rods against an end of its associated slot and pivoting the handle the fulcrum rod while creating relative movement between the other fulcrum rod and its associated slot; and wherein the continued chute handle movement includes applying torque to the torque-transferring mechanism from the handle through the abutment of the fulcrum rods with the ends of their associated slots.

* * * * *